US007191529B2

(12) United States Patent
Phipps et al.

(10) Patent No.: US 7,191,529 B2
(45) Date of Patent: Mar. 20, 2007

(54) APPARATUS AND METHOD FOR CONTROLLING A PROGRAMMABLE MARKING SCRIBE

(75) Inventors: Thomas J. Phipps, Washington, MI (US); Andrew J. Habedank, Port Huron Township, MI (US)

(73) Assignee: Columbia Marking Tools, Chesterfield Township, MI (US)

( * ) Notice: Subject to any disclaimer, the term of this patent is extended or adjusted under 35 U.S.C. 154(b) by 90 days.

(21) Appl. No.: 11/060,042

(22) Filed: Feb. 15, 2005

(65) Prior Publication Data

US 2006/0179670 A1 Aug. 17, 2006

(51) Int. Cl.
*B43L 13/00* (2006.01)
*B44B 5/00* (2006.01)

(52) U.S. Cl. ..... 33/18.1; 33/1 M; 101/3.1

(58) Field of Classification Search ..... 33/18.1, 33/1 M; 101/3.1, 4, 18, 19, 35; 400/18, 400/124.01, 124.04, 124.14, 124.15, 124.16, 400/124.17; 216/39, 44; 346/139 C
See application file for complete search history.

(56) References Cited

U.S. PATENT DOCUMENTS 2,818,500 A * 12/1957 Franck ..... 362/337
3,598,493 A * 8/1971 Fisher ..... 250/231.16
4,870,922 A 10/1989 Robertson
4,881,133 A * 11/1989 Redlich et al. ..... 358/3.32
4,883,291 A 11/1989 Robertson
4,972,323 A * 11/1990 Cauwet ..... 700/187
5,015,106 A 5/1991 Robertson et al.
5,119,109 A 6/1992 Robertson
5,167,457 A 12/1992 Cyphert et al.
5,246,319 A * 9/1993 Prince et al. ..... 409/80
5,316,397 A 5/1994 Robertson et al.
5,343,031 A * 8/1994 Yoshida ..... 235/494
5,594,991 A * 1/1997 Therond ..... 33/18.1
5,682,657 A * 11/1997 Hirose ..... 29/33 J
5,785,436 A 7/1998 Harrison et al.
5,789,892 A 8/1998 Takei
5,893,668 A 4/1999 Harrison et al.
6,070,480 A * 6/2000 Kerschner ..... 74/89.2
6,157,157 A * 12/2000 Prentice et al. ..... 318/625
6,276,225 B1 8/2001 Takeda et al.
6,423,935 B1 * 7/2002 Hackel et al. ..... 219/121.85
6,442,852 B1 9/2002 Shimotoyodome
6,460,257 B1 10/2002 Shimotoyodome
6,460,258 B1 10/2002 Shimotoyodome (Continued)

OTHER PUBLICATIONS

Website Printout of "TeleScribe® SS5500/420 Marking System", Telesis Marking Systems.

(Continued)

*Primary Examiner*—Diego Gutierrez
*Assistant Examiner*—Amy R. Cohen
(74) *Attorney, Agent, or Firm*—Brooks Kushman P.C.

(57) ABSTRACT

A programmable marking scribe having a material displacement stylus movable in three mutually orthogonal axes to displace material from an object being marked and create a two-dimensional matrix of recessed areas formed of grooves and surrounded by ridges, the grooves and ridges forming a reflectively multifaceted data cell having a collective reflectance that is in contrast with unmarked surface reflectance to enable a reader to clearly distinguish the former from the latter even in the presence of extraneous interfering marks and deposits.

20 Claims, 5 Drawing Sheets

U.S. PATENT DOCUMENTS

| | | | | |
|---|---|---|---|---|
| 6,467,405 | B1 * | 10/2002 | Breiholdt | 101/32 |
| 6,470,782 | B1 | 10/2002 | Shimotoyodome | |
| 6,478,206 | B2 | 11/2002 | Shimotoyodome | |
| 6,536,121 | B1 | 3/2003 | Ishikawa et al. | |
| 6,592,261 | B2 | 7/2003 | Mochizuki | |
| 6,719,468 | B2 | 4/2004 | Gatta | |
| 6,729,760 | B2 | 5/2004 | Mochizuki et al. | |
| 6,755,125 | B2 * | 6/2004 | Andrew et al. | 101/4 |
| 6,761,482 | B2 | 7/2004 | Ueno | |
| 6,779,441 | B2 | 8/2004 | Jun | |
| 6,804,889 | B2 | 10/2004 | Ishikawa et al. | |
| 6,826,840 | B1 * | 12/2004 | Lindsey et al. | 33/18.1 |
| 6,840,721 | B2 * | 1/2005 | Kaule et al. | 409/132 |
| 6,850,592 | B2 * | 2/2005 | Schramm et al. | 378/45 |
| 2003/0033104 | A1 | 2/2003 | Gooche | |
| 2005/0086816 | A1 * | 4/2005 | Siegel | 33/18.1 |

OTHER PUBLICATIONS

Website Printout of Product Information of International Engraving Devices, Inc. of Mountain View, CA, 2004.
Website Printout of Product Information of Vivi.
"Two-Dimensional Codes Leave Their Mark", A. Habedank and L. Dorazio, Foundry Management & Technology, Apr. 2004.
"Bar Code 1—2 Dimensional Bar Code Page", 104 Adams Communications, 1995.

* cited by examiner

APPARATUS AND METHOD FOR CONTROLLING A PROGRAMMABLE MARKING SCRIBE

BACKGROUND OF THE INVENTION

1. Field of the Invention

The present invention relates generally to marking scribes that encode data onto hard materials and more particularly to marking scribes that encode data represented by two-dimensional matrices.

2. Background Art

Marking systems used in applications such as part identification, tracking, inventory control, and order fulfillment are well known in the art. Early systems used characters attached to parts with tags, imprinted on parts with ink or paint, or punched into part surfaces. These forms of marking often required manual effort when marks were applied and additional manual effort when the marks were read. Later innovations including magnetic and optical alphanumeric data character recognition systems provided a degree of automated identification. A familiar and more recent system uses bar code recognition.

The previous and present systems solved many part identification problems and provided improved efficiencies, however a number of problems remain. For example, surface roughness and data character deterioration, debilitation and obscuration still affect identification accuracy and speed. Such problems usually worsen with time and wear, and demands for part tracking capabilities that extend beyond the manufacturing, storing and shipping of parts to the end of their useful lives have motivated the development of a two-dimensional marking process. This process features an advantageous pairing of small size and large data encoding capacity, and it facilitates full-life-cycle traceability of individual parts and assemblies.

The two-dimensional process, known as Direct Part Mark Identification (DPMI), includes the formation of a two-dimensional data matrix typically represented by a rectangular field of data cells arranged in columns and rows. The condition of each data cell represents a binary unit of information, and a number of processes have been developed to provide a detectable contrast between "marked" and "unmarked" data cells. Marking includes such processes as ink-jet printing, during which ink droplets are propelled onto the surface of a material being marked. Colored dye is left upon the surface when the ink evaporates. This process is capable of marking fast-moving parts and provides good contrast. Surfaces to be marked in this manner, however, often require preparation to ensure that the chemical reaction between the ink and the surface will maximize contrast and permanence of the mark.

Electrochemical etching is also used to mark part surfaces. During this process, a stencil is sandwiched between the part surface and an electrolyte-soaked pad; and a low electrical potential is applied across the part and the pad. This results in an oxidation of the exposed part surface, and produces a mark defined by the configuration of the stencil. This marking process commonly finds application in marking round surfaces and stress-sensitive parts. Disadvantages of electrochemical marking systems are that its automation can be difficult and that only conductive material can be processed.

Another part-marking process uses a laser to melt or vaporize the surface of a part to produce a detectable mark. Such a process can produce consistent, precision, round, square and linear marks at high speed. It is easily automated, requires no tool replacement, and requires only position fixturing. Marks produced are of high quality, but the quality is subject to interactions of the laser with the material being marked. Disadvantages of laser marking systems are that the equipment is relatively expensive and that the process is not readily applicable to irregular surfaces.

Dot peening is yet another part-marking process. It involves driving a stylus into the surface of a material being marked to leave, in a specific data cell, an indentation that contrasts with the surface of the material. The dot-peening process is relatively inexpensive, it produces good-quality marks, there is less material stress as compared to steel stamping processes, and there are no consumables. The parts, however, must be securely fixtured; and the noise level attending the process is relatively high. Also, in certain situations, marking surface preparation, such as cleaning or even machining, might be required to ensure code readability.

SUMMARY OF THE INVENTION

A programmable marking scribe having a material displacement stylus movable in three mutually orthogonal axes to displace material from an object being marked and create a two-dimensional matrix of recessed areas formed of grooves and surrounded by ridges, the grooves and ridges forming a reflectively multifaceted data cell having a collective reflectance that is in contrast with unmarked surface reflectance to enable a reader to clearly distinguish the former from the latter even in the presence of extraneous interfering marks and deposits.

The marking scribe has x-, y- and z-axis housings extending along x-, y- and z-axes, respectively, a stylus holder supported by the z-axis housing for mounting the stylus, and a programmable controller. It also has an x-axis driver supported by the x-axis housing for moving the y-axis housing parallel to the surface of the material and in a direction of the x-axis. A y-axis driver is supported by the y-axis housing for moving the z-axis housing parallel to the surface of the material and in a direction of the y-axis, and a z-axis driver is supported by the z-axis housing for moving the stylus holder at right angles to the surface of the material and in a direction of the z-axis.

The x-, y- and z-axis drivers are operatively responsive to signals generated by the programmable controller according to a program that calculates the size and disposition of individual recessed areas required to form a two-dimensional matrix pattern representing coded marking data. The programmable controller also dictates the motions of the stylus along each respective axis to form the pattern according to specified overall matrix dimensions. Each recessed area preferably has a rectangular configuration and is formed by the stylus in a series of only four movements along adjoining axes and in directions parallel to the material surface.

When not being used to create rectangular recessed areas for a two-dimensional matrix pattern representing coded marking data, the programmable marking scribe is capable of forming straight and curved lines as desired.

DETAILED DESCRIPTION OF THE PREFERRED EMBODIMENT(S)

Figure 1:
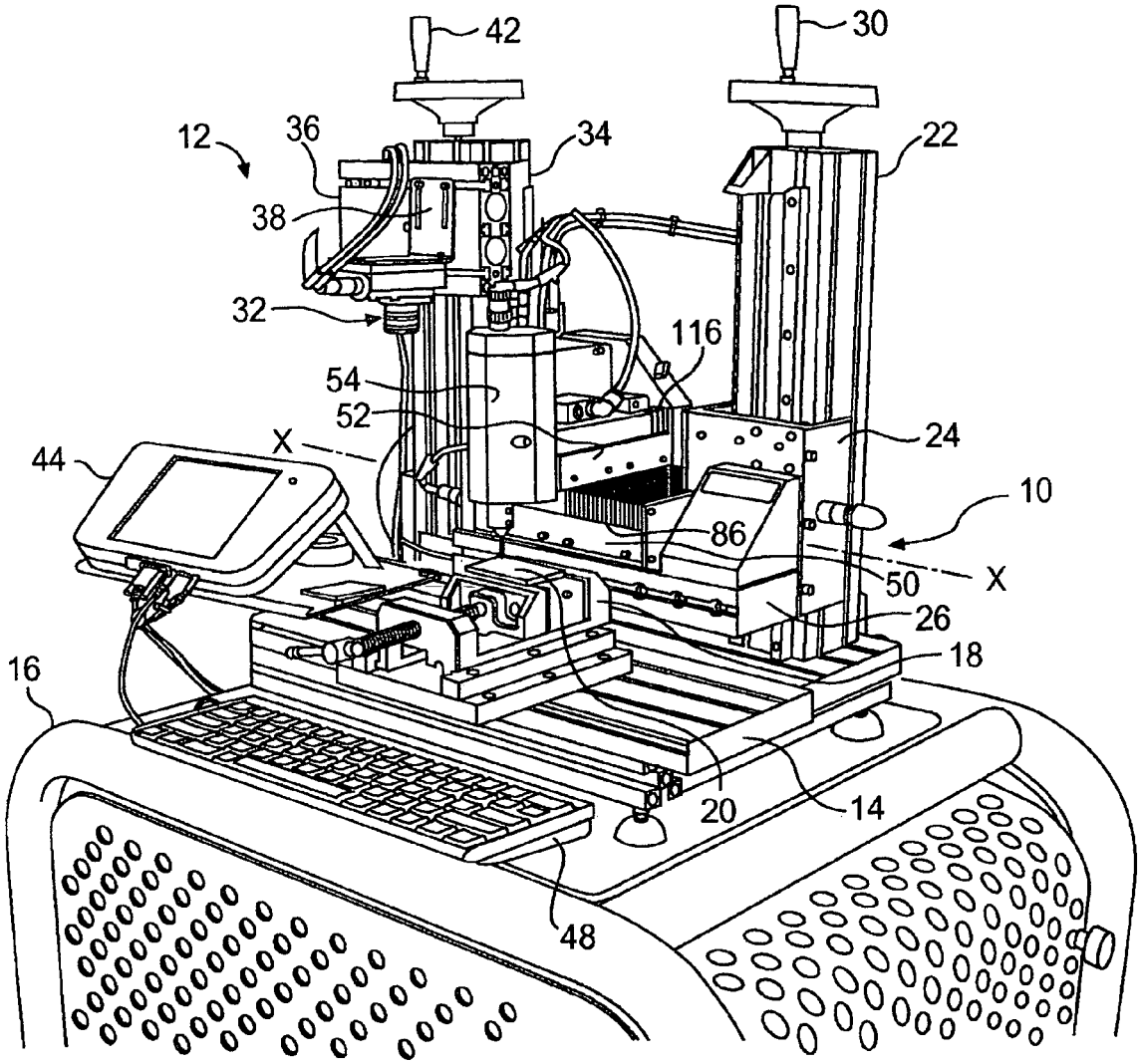
FIG. 1 is a perspective view of the programmable marking scribe of the present invention shown mounted on a representative work station.
Figure 2:
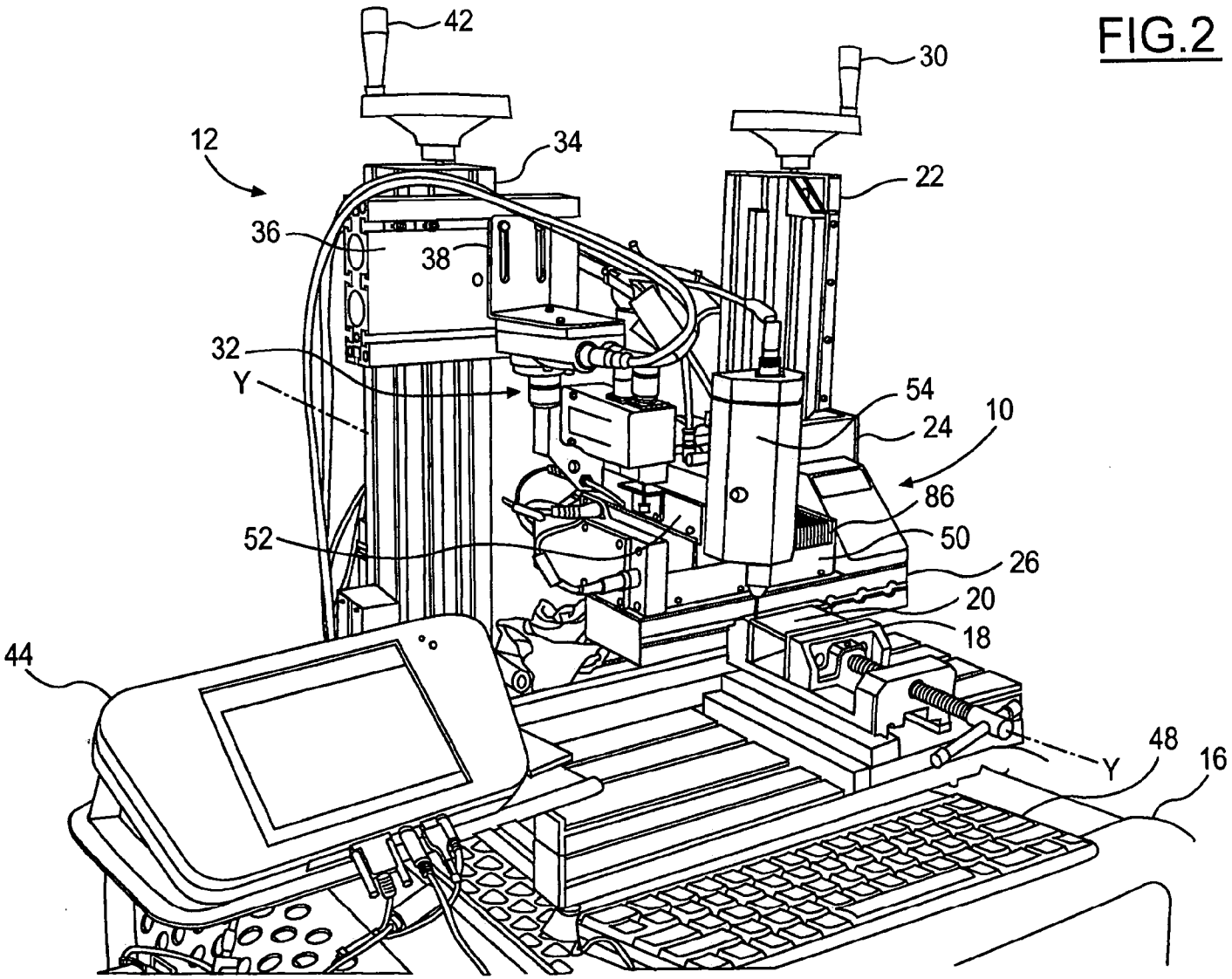
FIG. 2 shows the programmable marking scribe of FIG. 1 from a different perspective.
Figure 3:
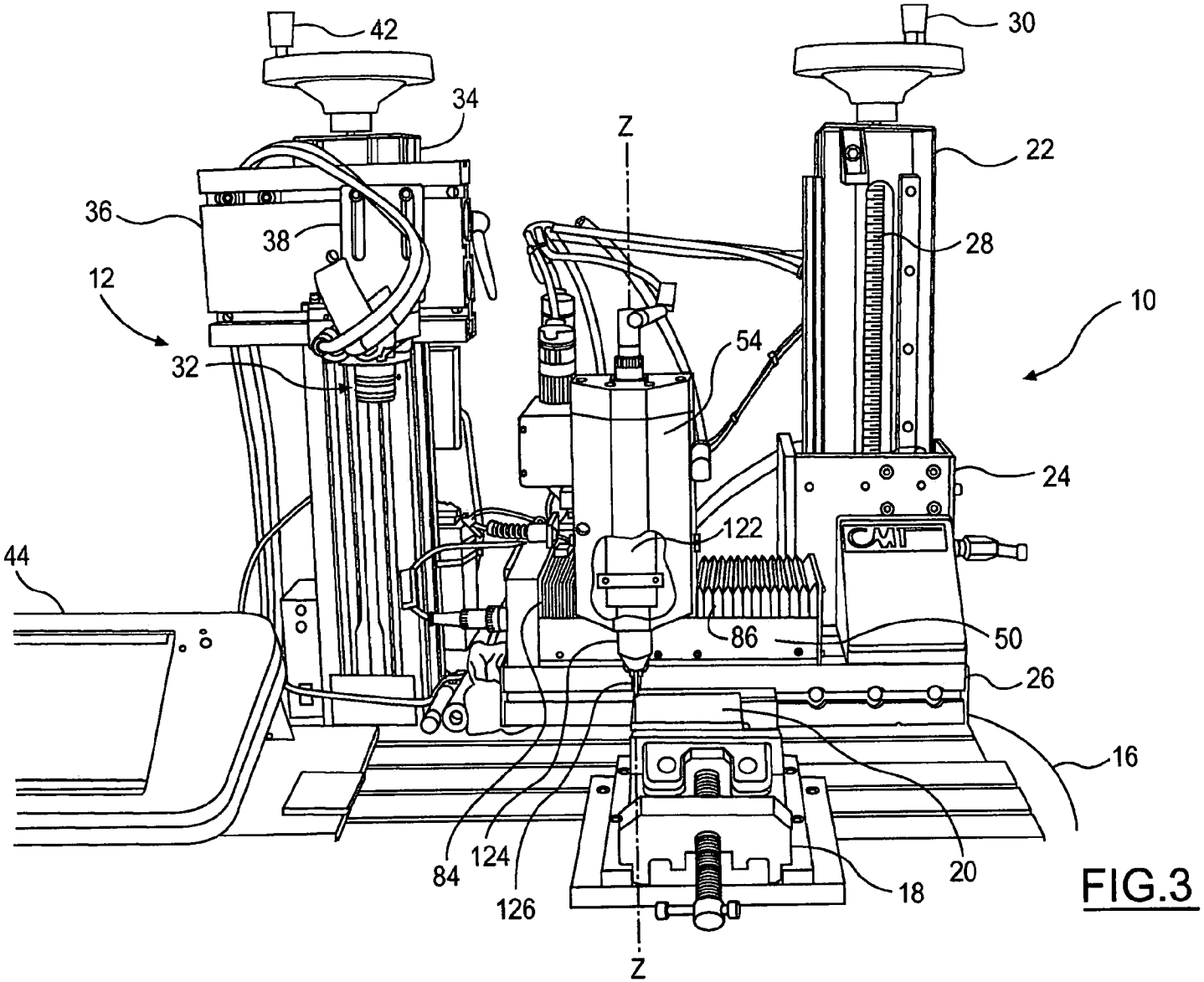
FIG. 3 shows the programmable marking scribe of FIGS. 1 and 2 from a different perspective.

FIGS. 1, 2 and 3 show perspective views of the programmable marking scribe of the present invention. The marking scribe is generally indicated by the reference numeral 10 and is shown mounted on an apparatus exemplifying a marking station, generally indicated by the reference numeral 12. The marking station 12 includes a support base 14 mounted atop a stand 16. A workpiece holder 18 is mounted on the support base 14. The workpiece holder 18 is shown holding a representative workpiece, or part, 20; but it could be an object having a different size. A marking scribe support member 22 is shown extending upwardly from the support base 14, and a marking scribe slide 24 is shown slidably attached to the marking scribe support member 22. The marking scribe 10 is mounted on a marking scribe base 26, which is secured to the marking scribe slide 24. The marking scribe support member 22 has a marking scribe elevating screw 28 (best shown by FIG. 3) that is rotatable by a marking scribe screw crank 30 to raise and lower the marking scribe slide 24 and thus the marking scribe base 26 and the marking scribe 10.

Figure 8:
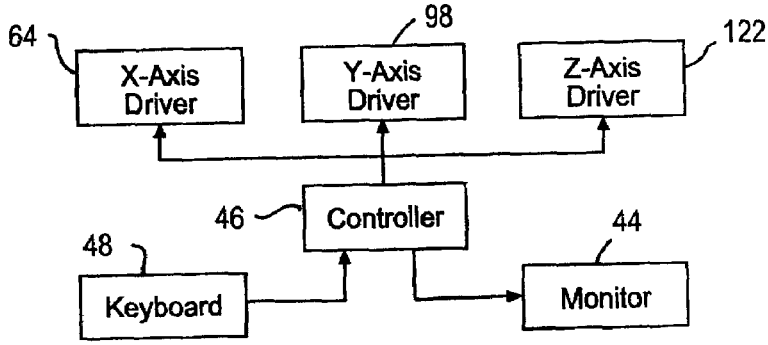
FIG. 8 is a block diagram showing a combination of an x-axis driver, a y-axis driver, a z-axis driver and a programmable controller of the present invention.

Also shown by FIGS. 1, 2 and 3 is a reader, generally indicated by the reference numeral 32. A reader support member 34 is shown extending upwardly from the support base 14, and a reader slide 36 is shown slidably attached to the reader support member 34. The reader 32 is attached to the reader slide 36 with a reader bracket 38. The reader support member 34 has a reader elevating screw similar to the elevating screw 28 (best shown by FIG. 3) and is rotatable by a reader screw crank 42 to raise and lower the reader slide 36 and thus the reader 32. Shown mounted on the marking support base 14 is a monitor 44 for displaying information in response to signals received from a programmable controller 46 (FIG. 8). A controller input keyboard 48 (FIGS. 1 and 2) is also shown located upon the stand 16 for manually entering data and commands into the programmable controller 46. The programmable controller 46 typically includes such elements as a microprocessor, computer-readable storage media for storing data representing instructions executable to control the marking scribe 10, and input-output circuitry.

Figure 4:
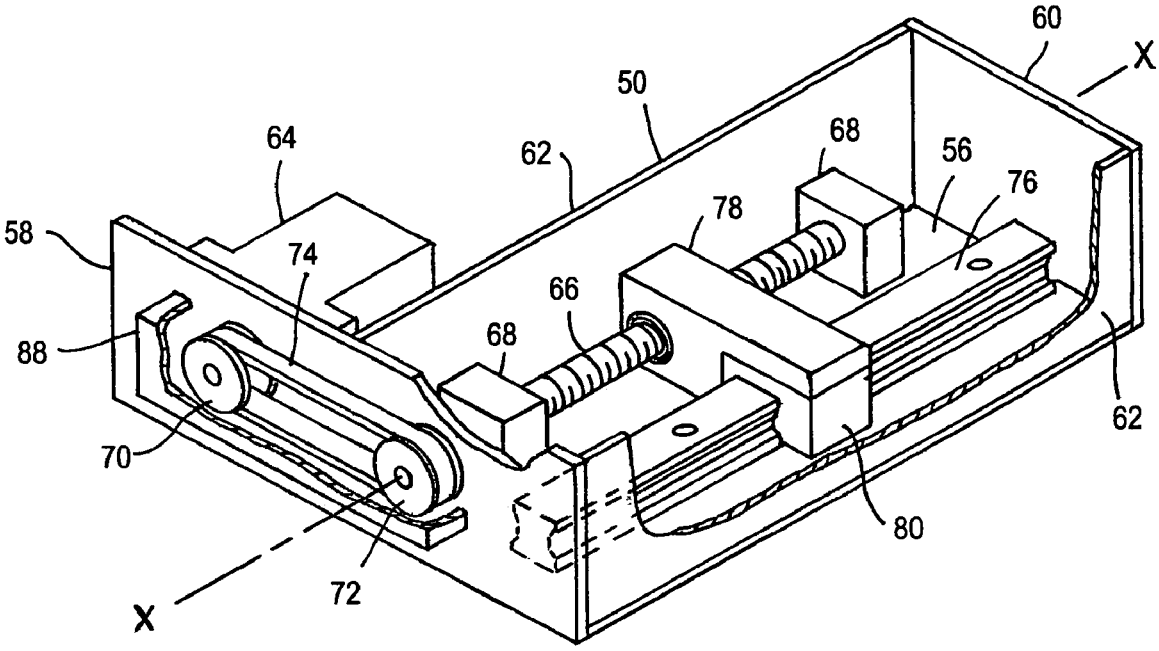
FIG. 4 is a perspective view of an apparatus that positions a stylus of the programmable marking scribe along an x-axis.

The marking scribe 10 includes an x-axis housing 50, a y-axis-housing 52 and a z-axis housing 54, each extending along x-, y- and z-axes (FIGS. 1 through 5) which are mutually orthogonal. FIG. 4 shows a perspective view, partially cut away, of the x-axis housing 50, which includes a base plate 56, an x-axis housing rear backing plate 58, an x-axis housing end plate 60 and two x-axis housing side plates 62, 62 generally configured to form an open-topped, elongate, rectangular box. Mounted on the x-axis housing rear backing plate 58 is an x-axis driver 64, which, depending on cost and application requirements, could be either a stepper motor or a servo motor. An x-axis ball screw 66 extends in a direction of the x-axis X and is rotatably supported at each of its ends by one of a pair of bearing blocks 68, 68 secured to the x-axis housing base plate 56. An x-axis driver sprocket 70 is secured to the x-axis driver 64, an x-axis driven sprocket 72 is secured to the x-axis ball screw 66, and an x-axis belt 74 communicates rotation of the x-axis driver sprocket 70 caused by the x-axis driver 64 to the x-axis driven sprocket 72 and thus to the x-axis ball screw 66.

At least one x-axis linear motion guide 76 (FIG. 4) is secured to the base plate 56 of the x-axis housing 50 and extends parallel to and spaced apart from the x-axis ball screw 66. An x-axis slide block 78, a portion of which serves as a ball nut, is driven in a direction of the x-axis by the rotating x-axis ball screw 66. An x-axis slide 80 is secured to the x-axis slide block 78 and is supported and slidably guided by the x-axis linear motion guide 76. The x-axis slide block 78 is connected to the y-axis housing 52 for moving the y-axis housing 52 in a direction of the x-axis X (FIG. 1). Extendable and retractable protective bellows 84 and 86 (FIG. 3) cover portions of the x-axis housing 50 wherein moving parts are located. An x-axis belt cover 88 is secured to the x-axis housing rear backing plate 58 to cover the x-axis driver 70 sprocket , the x-axis driven sprocket 72 and the x-axis belt 74.

Figure 5:
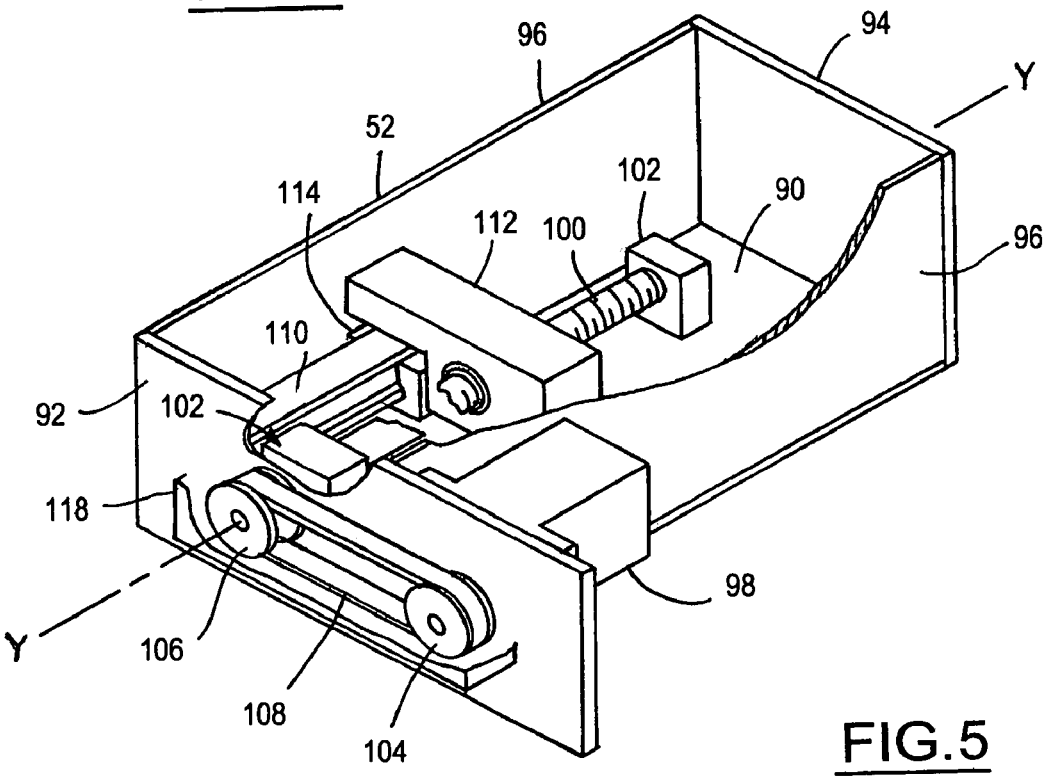
FIG. 5 is a perspective view of an apparatus that positions the stylus of the programmable marking scribe along a y-axis.

FIG. 5 shows a perspective view, partially cut away, of the y-axis housing 52, which includes the y-axis housing base plate 90, a y-axis housing rear backing plate 92, a y-axis housing end plate 94 and two y-axis housing side plates 96, 96 generally configured to form an open-topped, elongate, rectangular box. Mounted on the y-axis housing rear backing plate 92 is a y-axis driver 98, which, depending on application requirements, could be either a stepper motor or a servo motor. A y-axis ball screw 100 extends in a direction of the y-axis Y and is rotatably supported at each of its ends by one of a pair of y-axis bearing blocks 102, 102 secured to the y-axis base plate 90. A y-axis driver sprocket 104 is secured to the y-axis driver 98, a y-axis driven sprocket 106 is secured to the y-axis ball screw 100, and a y-axis belt 108 communicates rotation of the y-axis driver sprocket 104 caused by the y-axis driver 98 to the y-axis driven sprocket 106 and thus to the y-axis ball screw 100.

A y-axis slide 114 is secured to the y-axis housing base plate 90. The y-axis slide 114 also supports and slidably guides at least one y-axis linear motion guide 110, which in turn is connected to a y-axis slide block 112. The y-axis slide block 112 is driven in a direction of the y-axis by the rotating y-axis ball screw 100 and is connected to the z-axis housing 54 for moving the z-axis housing 54 in a direction of the y-axis Y. An extendable and retractable y-axis protective bellows 116 (FIG. 1) covers a portion of the y-axis housing 52 wherein moving parts are located. A y-axis belt cover 118 is secured to the y-axis housing rear backing plate 92 to cover the y-axis driver sprocket 104, the y-axis driven sprocket 106 and the y-axis belt 108.

The x-axis and y-axis slide blocks 78 and 112, respectively, preferably have circulating rolling elements, such as ball bearings, that roll between bearing surfaces of the portions of the x-axis and y-axis slide blocks 78 and 112, respectively, that serve as ball nuts and of grooves in the x-axis and y-axis ball screws 66 and 100, respectively, to reduce friction. The x-axis and y-axis slides 80 and 114, respectively, also preferably have circulating rolling elements, such as ball bearings, that roll between bearing surfaces of the x-axis and y-axis slides 80 and 114, respectively, and of the x-axis and y-axis linear motion guides 76 and 110, respectively, to reduce friction, increase rigidity and ensure the linearity of slide block motion.

Figure 6:
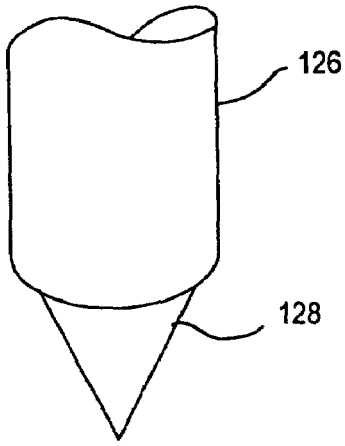
FIG. 6 shows a stylus tip having a configuration of a right circular cone.
Figure 7:
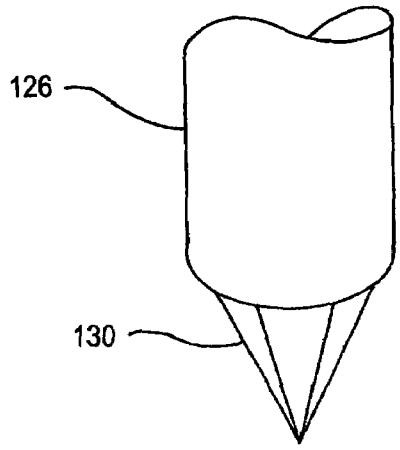
FIG. 7 shows a stylus tip having a configuration of a hexagonal pyramid.

FIG. 3 shows a partially broken away view of the z-axis housing 54, to which is secured a z-axis driver 122, which is preferably an electric solenoid, but, depending on application requirements, could be a pneumatic driver. Secured to the z-axis driver 122 is a stylus holder 124 and to that, a stylus 126. The stylus 126 preferably has a diamond tip, which, depending on application requirements, could have a configuration of a right circular cone 128 (FIG. 6) or of a polygonal pyramid. Preferred for use in the marking scribe 10 of the present invention is a tip having a configuration of a hexagonal pyramid 130 FIG. 7). It should be noted that the marking scribe 10 can be used, in addition to making two-dimensional data matrices typically represented by rectangular fields of rectangular data cells arranged in columns and rows, to scribe other linear and curved marks such as letters, numbers and various symbols. In such instances, stylus tips having other than hexagonal configurations might be preferred.

FIG. 8 is a block diagram that illustrates the operating relationship of the major elements of the marking scribe 10. The x-, y- and z-axis drivers 64, 98 and 122, respectively, are connected to the programmable controller 46 to receive driver control signals. The controller input keyboard 48 is connected to the programmable controller 46 for manually entering data and commands into the programmable controller 46, and the monitor 44 is connected to the programmable controller 46 for displaying information in response to signals received from the programmable controller 46.

Figure 9:
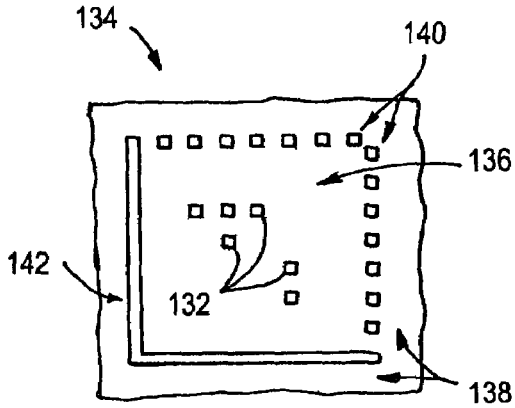
FIG. 9 shows a representative two-dimensional data matrix.

In operation, information defining data to be included in a two-dimensional data matrix pattern representing coded marking data is supplied to the programmable controller 46 (FIG. 8), for example, by a storable program and/or by the controller input keyboard 48. FIG. 9 shows a representative two-dimensional data matrix, generally indicated by the reference numeral 134. Data is encoded in the data matrix 134 as specifically arranged data cells 132, which are represented by individual rectangles, within a data region, generally indicated by the reference numeral 136. The programmable controller 46 (FIG. 8) determines the size and disposition of the data cells 132. Note that an actual data matrix would typically include many more data cells than are shown in FIG. 9.

A quiet zone, generally indicated by the reference numeral 138, is provided around all sides of the data region 136 to aid the programmable controller 46 (FIG. 8) in clearly delineating margins of the data matrix 134. Cells aligned across the top and right sides of the data region provide a clocking pattern, or clock track, generally indicated by the reference numeral 140. The clocking pattern 140 defines the configuration of the pattern of data cells 132 within the data region 136. Ideally, an area of the clocking pattern 140 occupied by a data cell 132 and one not occupied by a data cell are of equal size. An L-shaped finder pattern, generally indicated by the reference numeral 142, extends along the left and bottom sides of the data region 136. The two bars forming the L are orthogonal and may be continuous or be formed of a series of closely spaced data cells. The finder pattern 142 enables a mark-reading process of the programmable controller 46 to locate the data region 136 and to compensate electronically for any angular disorientation of the data matrix 134.

When a data cell is to be created, the programmable controller 46 (FIG. 8) directs the x-axis driver 64 (FIG. 4) to rotate the x-axis ball screw 66 (FIG. 4), which causes the x-axis slide block 78 to move and position the y-axis housing 52, to which the x-axis slide block 78 is attached, along a direction of the x-axis X. The programmable controller 46 also directs the y-axis driver 98 to rotate the y-axis ball screw 100, which causes the y-axis slide block 112 to move and position the z-axis housing 54, to which the y-axis slide block 112 is attached, along a direction of the y-axis Y. This results in the stylus 126 (FIG. 3) being positioned directly over a point where the creation of a data cell 132 is to begin.

Figure 10:
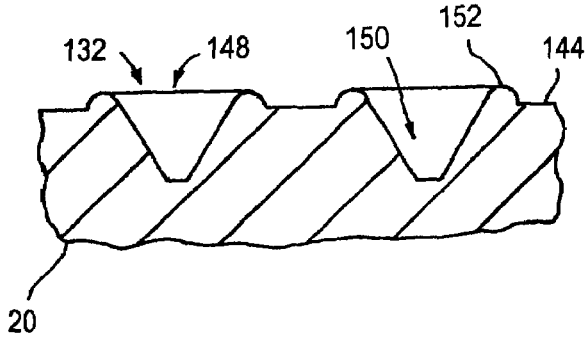
FIG. 10 is a cross-sectional view of data cells produced by the programmable marking scribe.

At this point, the programmable controller 46 (FIG. 8) directs the z-axis driver 122 to. force the stylus 126 to a specified depth beneath the surface 144 (FIG. 10) of the part 20 being marked. The programmable controller 46 then directs the x-axis and y-axis drivers 64 and 98, respectively, to move the stylus 126 laterally, following a specified, contiguous, rectangular path to form a groove 150 and displace material to form ridges 152 along the groove. This displaces material in a manner leaving a specifically shaped, recessed area, generally indicated by the reference numeral 148 (FIG. 10) formed of grooves, generally indicated by the reference numeral 150, and surrounded by ridges 152 of displaced material. The grooves 150- and the ridges 152 form a reflectively multifaceted data cell 132 having a collective reflectance that sufficiently contrasts with other surface reflectance to enable a reader to clearly distinguish the former from the latter even in the presence of extraneous interfering marks and deposits. Since the recessed area 148, as viewed from the direction of a reader, has a square configuration, the grooves 150 and the ridges 152 accordingly provide larger reflective areas than do, for example, reflective features of relatively comparably sized dot peen data cells and thus have excellent readability.

The programmable marking scribe of the present invention is capable of producing an accurate matrix within an average time of seven seconds. Data matrices tested using Automatic Identification and Mobility (AIM) verification standards earned a grade of "A" in a scale of grades from A (excellent) to F (fail) in test categories including data cell contrast, modulation, uniformity and unused error correction.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A marking scribe for marking a material, the marking scribe comprising a material displacement stylus that is movable in three mutually orthogonal x-, y- and z-axes to penetrate, in a direction of the z-axis, a surface of the material at a specific point to a specific depth and then, while the stylus is at the specific point and specific depth, moving in a direction of the x-axis and of the y-axis and parallel to the surface to displace material in a manner leaving a specifically shaped, recessed area formed of grooves and surrounded by ridges of displaced material, the grooves and ridges forming a reflectively multifaceted data cell having a collective reflectance that sufficiently contrasts with unmarked surface reflectance to enable a reader to clearly distinguish the former from the latter even in the presence of extraneous interfering marks and deposits.

2. A programmable marking scribe for marking a material, the programmable marking scribe comprising:

an x-axis housing extending along an x-axis;

a y-axis housing extending along a y-axis;

a z-axis housing extending along a z-axis;

a stylus holder slidably supported by the z-axis housing;

a material displacement stylus supported by the stylus holder;

a programmable controller;

an x-axis driver supported by the x-axis housing for moving the y-axis housing parallel to the surface of the material and in a direction of the x-axis;

a y-axis driver supported by the y-axis housing for moving the z-axis housing parallel to the surface of the material and in a direction of the y-axis; and a z-axis driver supported by the z-axis housing for moving the stylus holder at right angles to the surface of the material and in a direction of the z-axis, the x-axis, y-axis and z-axis drivers being operatively responsive to signals generated by the programmable controller according to a program that calculates the size and disposition of individual recessed areas required to form a two-dimensional matrix pattern representing coded marking data and that dictates the motions of the stylus along each respective axis to form the pattern according to specified overall matrix dimensions, each recessed area having a rectangular configuration and being formed by the stylus in a series of only four movements along adjoining axes and in directions parallel to the material surface to displace material in a manner leaving a specifically shaped recessed area formed of grooves and surrounded by ridges, the grooves and ridges forming a reflectively multifaceted data cell having a collective reflectance that sufficiently contrasts with unmarked surface reflectance to enable a reader to clearly distinguish the former from the latter even in the presence of extraneous interfering marks and deposits.

3. The programmable marking scribe as defined by claim 2, wherein the z-axis driver is an electric solenoid.

4. The programmable marking scribe as defined by claim 2, wherein the z-axis driver is a pneumatic driver.

5. The programmable marking scribe as defined by claim 2, wherein each of the x-axis and y-axis drivers is a stepper motor.

6. The programmable marking scribe as defined by claim 2, wherein each of the x-axis and y-axis drivers is a servo motor.

7. The programmable marking scribe as defined by claim 2, further comprising:

an x-axis ball screw connected to the x-axis driver for rotation thereby;

at least one x-axis linear motion guide secured to the x-axis housing and extending parallel to and spaced apart from the x-axis ball screw;

an x-axis slide that is slidably supported and guided by the at least one x-axis linear motion guide;

an x-axis slide block connected to and supported by the x-axis slide and driven in a direction of the x-axis by the rotating x-axis ball screw, the x-axis slide block being secured to the y-axis housing for moving the y-axis housing in a direction of the x-axis;

a y-axis ball screw connected to the y-axis driver for rotation thereby;

a y-axis slide secured to the y-axis housing;

at least one y-axis linear motion guide slidably supported and guided by the y-axis slide and extending parallel to and spaced apart from the y-axis ball screw; and a y-axis slide block connected to and supported by the at least one y-axis linear motion guide and driven in a direction of the y-axis by the rotating y-axis ball screw, the y-axis slide block being secured to the z-axis housing for moving the z-axis housing in a direction of the y-axis.

8. The programmable marking scribe as defined by claim 7, wherein the x-axis slide and the y-axis slide are circulating ball bearing slides.

9. The programmable marking scribe as defined by claim 7, wherein the stylus has a diamond tip.

10. The programmable marking scribe as defined by claim 9, wherein the diamond tip has a configuration of a polygonal pyramid.

11. The programmable marking scribe as defined by claim 10, wherein the polygonal pyramid configuration of the diamond tip is a hexagonal pyramid.

12. The programmable marking scribe as defined by claim 9, wherein the diamond tip has a configuration of a right circular cone.

13. A method of marking, along mutually orthogonal x-, y- and z-axes, a surface of an object with a marking scribe, the method comprising the steps of:

(a) providing a material displacement stylus having a pointed tip extending in a z-axis direction;

(b) positioning the stylus at a specific point adjacent the surface;

(c) urging the tip of the stylus in the z-axis direction to penetrate the surface to a specific depth; and (d) moving the stylus parallel to the surface along the x- and y-axes to displace material along contiguous paths that create a specifically shaped, recessed area formed of grooves and surrounded by ridges, the grooves and ridges forming a reflectively multifaceted data cell having a collective reflectance that sufficiently contrasts with unmarked surface reflectance to enable a reader to clearly distinguish the former from the latter even in the presence of extraneous interfering marks and deposits.

14. The method as defined by claim 13, wherein the stylus is moved as in step (d) in only four directions to create a recessed area having a rectangular configuration.

15. The method as defined by claim 14, further including repeating steps (b) through (d) to form a two-dimensional matrix of spaced apart data cells.

16. A method for marking a material with a programmable marking scribe, the method comprising the steps of:

(a) providing a material displacement stylus having a pointed tip extending in a z-axis direction;

(b) providing a programmable controller;

(c) determining with the programmable controller the size and disposition of recessed areas to form a two-dimensional matrix pattern representing desired coded marking data;

(c) positioning the stylus at a specific point adjacent the surface;

(d) urging the tip of the stylus in the z-axis direction to penetrate the surface to a specific depth; and (e) moving the stylus parallel to the surface along the x- and y-axes to displace material along contiguous paths that create a specifically shaped, recessed area formed of grooves and surrounded by ridges, the grooves and ridges forming a reflectively multifaceted data cell having a collective reflectance that contrasts with unmarked surface reflectance to enable a reader to clearly distinguish the former from the latter even in the presence of extraneous interfering marks and deposits.

17. The method as defined by claim 16, wherein the stylus is moved as in step (e) in only four directions to create a recessed area having a rectangular configuration.

18. The method as defined by claim 17, further including repeating steps (c) through (e) to form a two-dimensional matrix of spaced apart data cells.

19. A method of marking the surface of a material with a marking scribe to create a multifaceted data cell having a collective reflectance that contrasts with unmarked surface reflectance to enable a reader to clearly distinguish the former from the latter even in the presence of interfering marks and deposits on the surface, comprising the steps of:

(a) providing a material displacement stylus;

(b) moving said stylus in three mutually orthogonal x-, y- and z-axes to locate the stylus above the surface to be marked in a predetermined location;

(c) while in such location, moving the stylus along the z-axis to penetrate the surface to be marked;

(d) while the stylus is thus penetrating the surface along the z-axis, moving the stylus along x- and y- axes to displace material at the surface to form grooves surrounded by ridges ; and (e) withdrawing the stylus from the surface along the z-axis upon completion of the marking.

20. The method defined by claim 19, further including, prior to step (b), steps of:

providing a programmable controller; and determining with the programmable controller the size, configuration and disposition of recessed areas to form a two-dimensional matrix pattern representing desired coded marking data, the program controller generating signals representative of the determined size, configuration and disposition of the recessed areas to control movement of the material displacement stylus.

* * * * *